US011850865B2

(12) United States Patent
Oya et al.

(10) Patent No.: US 11,850,865 B2
(45) Date of Patent: Dec. 26, 2023

(54) CARTRIDGE AND PRINTING SYSTEM

(71) Applicant: SEIKO EPSON CORPORATION, Tokyo (JP)

(72) Inventors: Shun Oya, Kiso-machi (JP); Tadahiro Mizutani, Shiojiri (JP); Yoshihiro Koizumi, Shiojiri (JP); Takumi Nagashima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 102 days.

(21) Appl. No.: 17/707,128

(22) Filed: Mar. 29, 2022

(65) Prior Publication Data

US 2022/0314631 A1 Oct. 6, 2022

(30) Foreign Application Priority Data

Mar. 30, 2021 (JP) ..... 2021-056848

(51) Int. Cl.
*B41J 2/175* (2006.01)
*B41J 29/13* (2006.01)

(52) U.S. Cl.
CPC ..... *B41J 2/17523* (2013.01); *B41J 2/17509* (2013.01); *B41J 29/13* (2013.01)

(58) Field of Classification Search
CPC .... B41J 2/175; B41J 2/17503; B41J 2/17509; B41J 2/1752; B41J 2/17523; B41J 2/1753; B41J 29/13
See application file for complete search history.

(56) References Cited

U.S. PATENT DOCUMENTS 6,705,715 B2 * 3/2004 Morita ..... B41J 2/17513 347/7
8,733,909 B2 * 5/2014 Qin ..... B41J 2/17553 347/85
8,733,911 B2 * 5/2014 Mizutani ..... B41J 2/17513 347/86

FOREIGN PATENT DOCUMENTS

JP H09-020015 A 1/1997

* cited by examiner

*Primary Examiner* — Anh T Vo
(74) *Attorney, Agent, or Firm* — Oliff PLC

(57) ABSTRACT

The cartridge includes: a liquid containing portion, a liquid supply portion, an arrangement portion having the liquid supply portion arranged inside thereof and having a bottom wall facing a distal end of the liquid supply portion, in which the bottom wall has an opening portion through which the liquid introduction portion is inserted at a position facing the distal end, a first liquid absorbing member arranged inside the arrangement portion, of which a part of the first liquid absorbing member is exposed from the opening portion, and a second liquid absorbing member arranged inside the arrangement portion and coming into contact with the first liquid absorbing member.

3 Claims, 11 Drawing Sheets

CARTRIDGE AND PRINTING SYSTEM

The present application is based on, and claims priority from JP Application Serial Number 2021-056848, filed Mar. 30, 2021, the disclosure of which is hereby incorporated by reference herein in its entirety.

BACKGROUND

1. Technical Field

The present disclosure relates to technologies for a cartridge and a printing system.

2. Related Art

In the related art, a technology for an ink cartridge in which an absorbent that absorbs and holds ink is disposed in a recess formed over an outer peripheral side of an ink supply port and a rear end of a lower surface of a cartridge main body has been known (see JP-A-9-20015).

In the technology of the related art, the absorbent of the ink cartridge absorbs the ink leaked from the ink supply port in a gravity direction. However, in the related art, when the ink cartridge is removed from a printer, the absorbent cannot catch the ink scattered from a liquid introduction portion. In addition, the absorbent is too small to hold sufficient ink in the related art. The problem described above is not limited to the ink cartridge and the printer in which the ink cartridge is detachably mounted, and is common to a cartridge in which the cartridge containing a liquid in addition to the ink and a printing apparatus in which the cartridge is detachably mounted.

SUMMARY (1) According to a first aspect of the present disclosure, there is provided a cartridge that is detachably mounted in a printing apparatus including a liquid introduction portion. The cartridge includes: a liquid containing portion containing a liquid; a liquid supply portion coupled to the liquid introduction portion and supplying the liquid to the printing apparatus; an arrangement portion having the liquid supply portion arranged inside thereof and having a bottom wall facing a distal end of the liquid supply portion, in which the bottom wall has an opening portion through which the liquid introduction portion is inserted at a position facing the distal end; a first liquid absorbing member arranged inside the arrangement portion, of which a part of the first liquid absorbing member is exposed from the opening portion, and a second liquid absorbing member arranged inside the arrangement portion and coming into contact with the first liquid absorbing member.

(2) According to a second aspect of the present disclosure, there is provided a printing system. The printing system includes the cartridge according to the aspect, and the printing apparatus having the liquid introduction portion coupled to the liquid supply portion.

DESCRIPTION OF EXEMPLARY EMBODIMENTS

A. Embodiment

A-1. Configuration of Printing System

Figure 1:
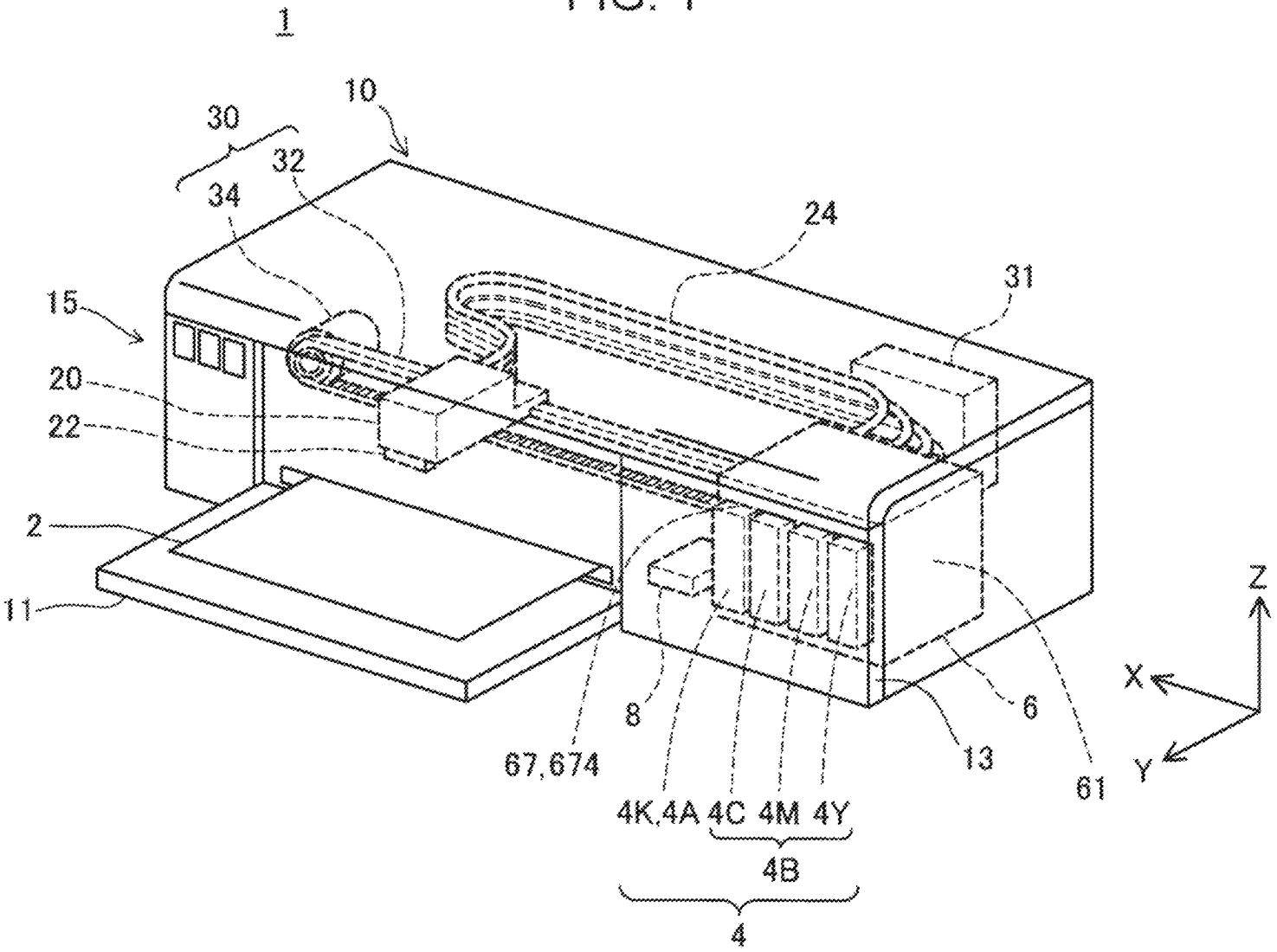
FIG. 1 is a perspective view illustrating a configuration of a printing system as an embodiment of the present disclosure.

FIG. 1 is a perspective view illustrating a configuration of a printing system 1 as an embodiment of the present disclosure. In FIG. 1, X, Y, and Z axes, which are three orthogonal spatial axes, are drawn. The directions in which the arrows of the X axis, the Y axis, and the Z axis are directed represent positive directions along the X axis, the Y axis, and the Z axis, respectively. The positive directions along the X axis, the Y axis, and the Z axis are denoted by a +X direction, a +Y direction, and a +Z direction, respectively. The reverse directions of the directions in which the arrows of the X axis, the Y axis, and the Z axis are directed are negative directions along the X axis, the Y axis, and the Z axis, respectively. The negative directions along the X axis, the Y axis, and the Z axis are denoted by a −X direction, a −Y direction, and a −Z direction, respectively. Directions along the X axis, the Y axis, and the Z axis regardless of whether being positive or negative are called an X direction, a Y direction, and a Z direction, respectively. This applies the same to the figures and descriptions to be described later.

The printing system 1 includes a printing apparatus 10, and a cartridge 4 supplying ink, which is a liquid, to the printing apparatus 10.

The printing apparatus 10 in the present embodiment is an ink jet printer that discharges the ink, as a liquid, from a discharge head 22. The printing apparatus 10 is a large printer that performs printing on a large-sized sheet (A2 to A0, and the like) such as a poster. The printing apparatus 10 includes a cartridge mounting portion 6, a control portion 31, a carriage 20, a discharge head 22, and a drive mechanism 30. In addition, the printing apparatus 10 includes an operation button 15 for a user to operate operations of the printing apparatus 10.

The cartridge mounting portion 6 has a first apparatus wall 67 located on the +Y direction side. The first apparatus wall 67 has an insertion/removal opening portion 674 as an inlet/outlet of the cartridge 4 to an accommodation chamber 61. The cartridge 4 is accommodated in the accommodation chamber 61 of the cartridge mounting portion 6 via the insertion/removal opening portion 674, and the cartridge 4 is removed from the accommodation chamber 61. A plurality of cartridges 4 are detachably mounted in the cartridge mounting portion 6. In the present embodiment, four types of cartridges 4, corresponding to ink having four colors of black, yellow, magenta, and cyan, are mounted in the cartridge mounting portion 6 one by one, that is, a total of four cartridges 4 are mounted in the cartridge mounting portion 6. The cartridge 4 containing black ink is referred to as a cartridge 4K, the cartridge 4 containing yellow ink is referred to as a cartridge 4Y, the cartridge 4 containing magenta ink is referred to as a cartridge 4M, and the cartridge 4 containing cyan ink is referred to as a cartridge 4C. In the present embodiment, the cartridge 4K is configured to contain more liquid than the cartridges 4C, 4M, and 4Y. Thus, the cartridge 4K is referred to as a first-type cartridge 4A, and the cartridges 4C, 4M, and 4Y are referred to as a second-type cartridge 4B.

The printing apparatus 10 has a replacement cover 13 on a front surface thereof in the +Y direction side. When the +Z direction side of the replacement cover 13 is tilted forward, that is, tilted to the +Y direction side, an opening of the cartridge mounting portion 6 appears and the cartridge 4 can be detached. When the cartridge 4 is mounted in the cartridge mounting portion 6, the ink can be supplied to the discharge head 22 that is provided on the carriage 20 via a tube 24 as a liquid circulating tube. In the present embodiment, the ink is supplied from the cartridge 4 to the discharge head 22 with a head difference. Specifically, the ink is supplied to the discharge head 22 due to a head difference between a liquid level of the ink in the cartridge mounting portion 6 and the discharge head 22. In another embodiment, a pump mechanism (not illustrated) of the printing apparatus 10 may suck the ink in the cartridge 4 to supply the ink to the discharge head 22. The tube 24 is provided for each type of the ink. Here, a state in which the cartridge 4 is mounted in the cartridge mounting portion 6 and the ink, as a liquid, can be supplied to the printing apparatus 10 is referred to as a "mounted state".

A nozzle for each type of ink is provided on the discharge head 22. The discharge head 22 discharges the ink from the nozzle toward a printing sheet 2 and prints data such as characters or images on the printing sheet 2. In the present embodiment, the printing apparatus 10 is a so-called "off-carriage type" printer in which the cartridge mounting portion 6 is not interlocked with the movement of the carriage 20. A technology of the present disclosure can also be applied to a so-called "on-carriage type" printer in which the cartridge mounting portion 6 is provided on the carriage 20 and the cartridge mounting portion 6 moves together with the carriage 20.

The control portion 31 controls each portion of the printing apparatus 10, and transmits and receives a signal to and from the cartridge 4. The carriage 20 relatively moves the discharge head 22 to the printing sheet 2.

The drive mechanism 30 reciprocates the carriage 20 based on a control signal from the control portion 31. The drive mechanism 30 includes a timing belt 32 and a drive motor 34. The carriage 20 reciprocates in a main scanning direction, which is a direction along the X direction, by transmitting power of the drive motor 34 to the carriage 20 via the timing belt 32. In addition, the printing apparatus 10 includes a transport mechanism for moving the printing sheet 2 in a sub-scanning direction which is the +Y direction. When printing is performed, the transport mechanism moves the printing sheet 2 in the sub-scanning direction, and the printed printing sheet 2 is output onto a front cover 11.

A region called a home position is provided at a position outside a printing region where the carriage 20 is moved in the main scanning direction, and a maintenance mechanism that performs maintenance to normally perform printing is mounted at the home position. The maintenance mechanism includes a cap member 8 that is pushed against a surface where the nozzle is formed on a bottom surface side of the discharge head 22 and forms a closed space so as to surround the nozzle, a lifting mechanism (not illustrated) that lifts the cap member 8 to be pushed against a nozzle surface of the discharge head 22, a suction pump (not illustrated) that introduces a negative pressure into the closed space where the cap member 8 is formed by being pushed against the nozzle surface of the discharge head 22, and the like.

In the present embodiment, in the use state of the printing system 1, an axis along the sub-scanning direction of transporting the printing sheet 2 is defined as the Y axis, an axis along the gravity direction is defined as the Z axis, and an axis along the movement direction of the carriage 20 is defined as the X axis. Here, "the use state of the printing system 1" refers to a state in which the printing system 1 is installed on a horizontal surface. In the present embodiment, the sub-scanning direction is defined as the +Y direction, a direction opposite to the +Y direction is referred to as the −Y direction, and the gravity direction is defined as the −Z direction, and the antigravity direction is defined as the +Z direction. The X direction and the Y direction are directions along the horizontal direction. When the printing system 1 is viewed from a front side, a direction from the left side to the right side is defined as the +X direction, and a direction opposite to the +X direction is defined as the −X direction. In the present embodiment, an insertion direction in which the cartridge 4 is inserted into the cartridge mounting portion 6 for mounting is defined as the −Y direction, and a direction in which the cartridge 4 is removed from the cartridge mounting portion 6 is defined as the +Y direction. Thus, in the cartridge mounting portion 6, a −Y direction side is referred to as a depth side, and a +Y direction side is referred to as a front side. In the present embodiment, an arrangement direction of the plurality of cartridges 4 is defined as the X direction.

A-2. Description of Mounting Process and Mounted State of Cartridge

Figure 2:
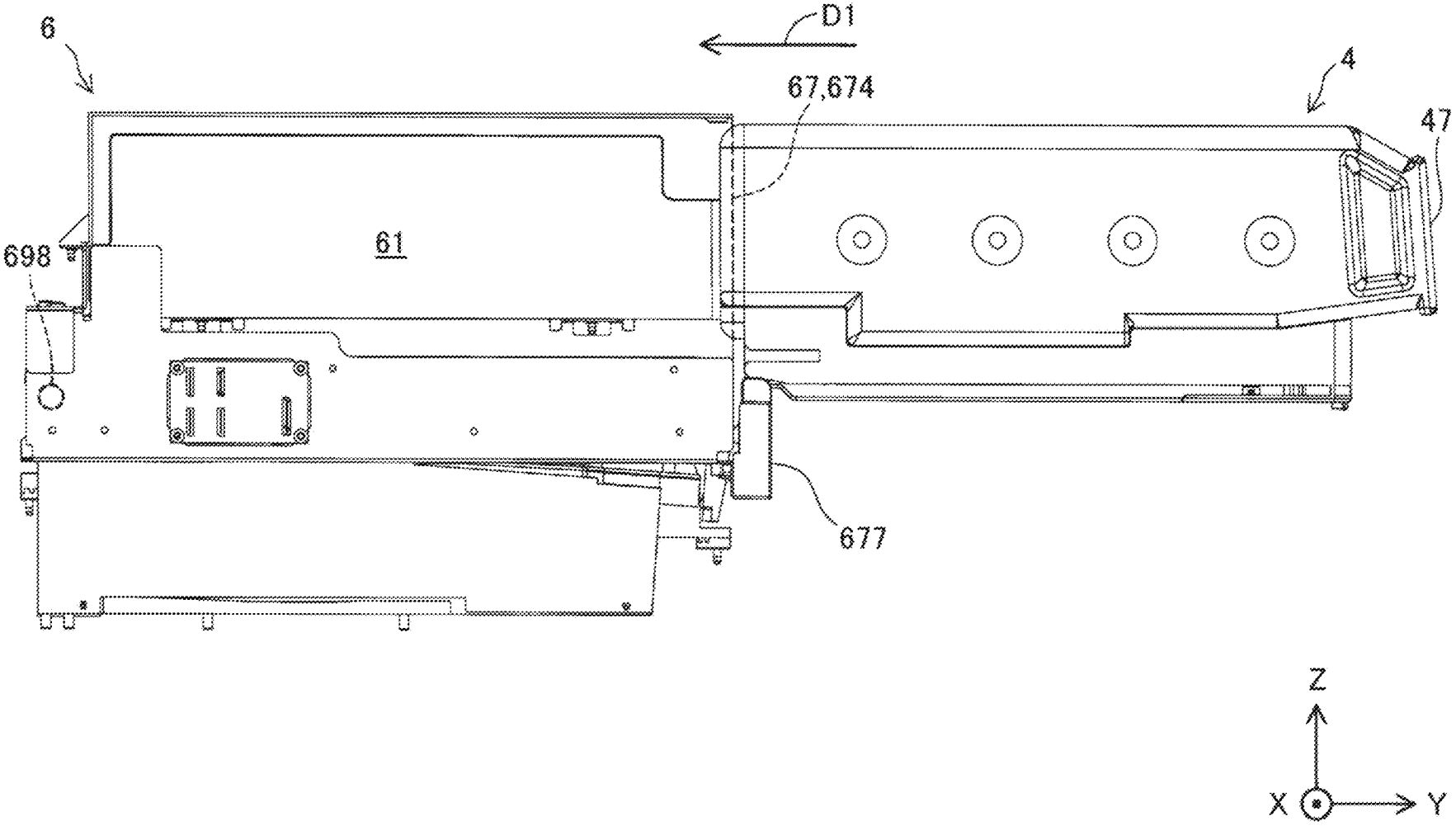
FIG. 2 is a first view illustrating a mounting process of the cartridge in a cartridge mounting portion.
Figure 3:
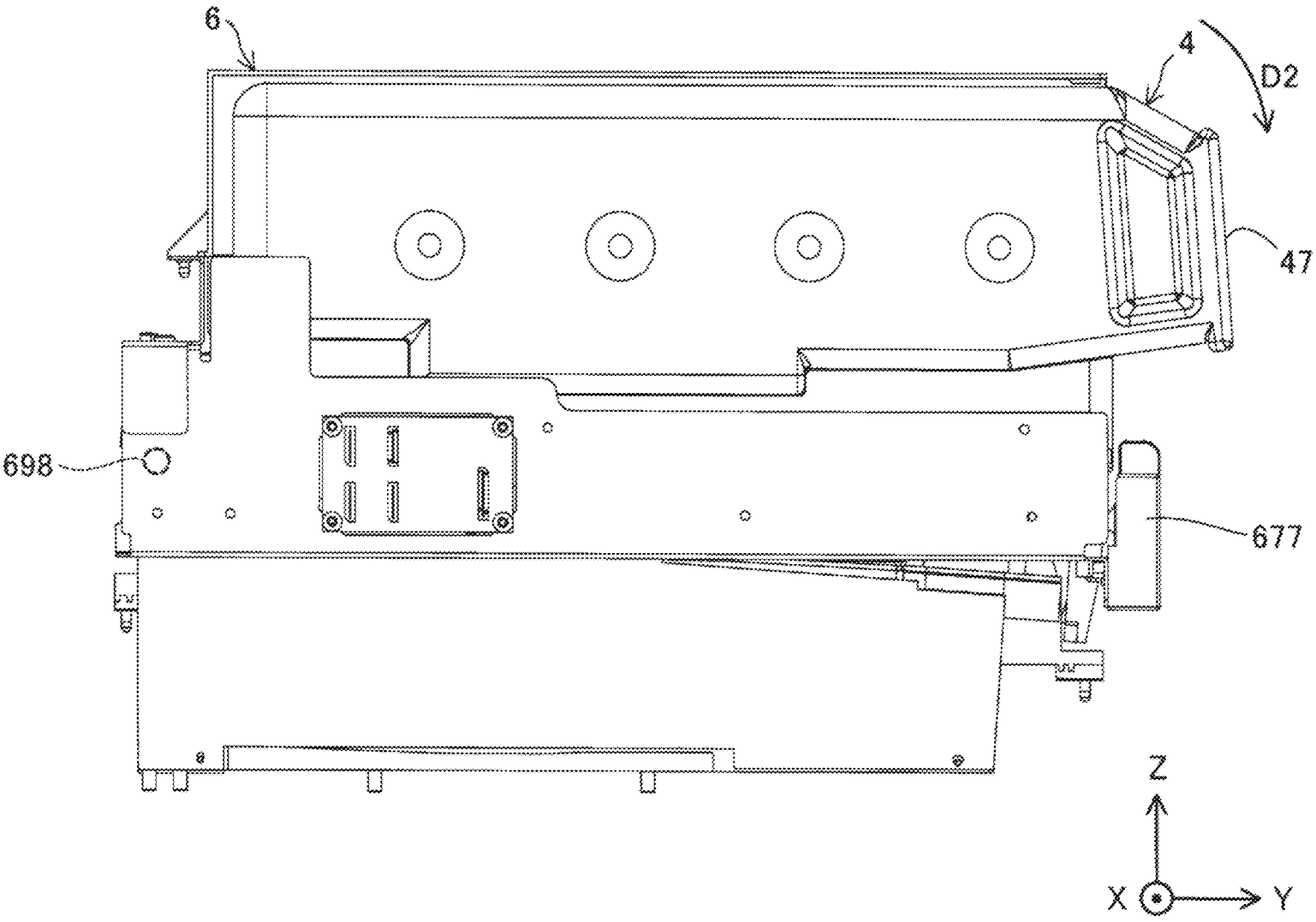
FIG. 3 is a second view illustrating the mounting process.
Figure 4:
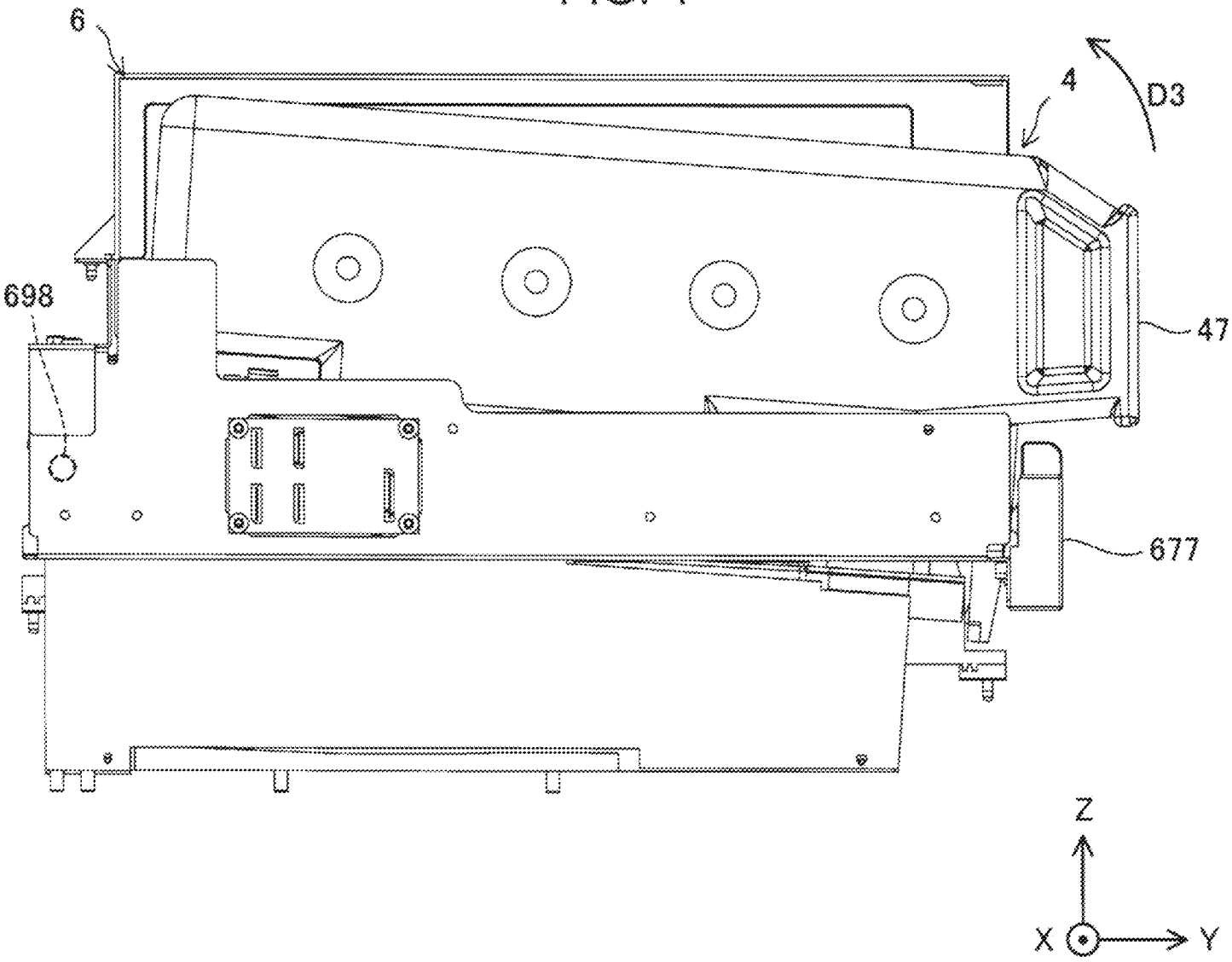
FIG. 4 is a view illustrating a mounted state in which the mounting of the cartridge in the cartridge mounting portion is completed.

FIG. 2 is a first view illustrating a mounting process of the cartridge 4 in a cartridge mounting portion 6. FIG. 3 is a second view illustrating the mounting process. FIG. 4 is a view illustrating a mounted state in which the mounting of the cartridge 4 in the cartridge mounting portion 6 is completed.

The mounting process includes a terminal coupling process and a supply portion coupling process performed after the terminal coupling process. As illustrated in FIG. 2, the terminal coupling process is a process in which an apparatus-side terminal (to be described later) of the cartridge mounting portion 6 and a cartridge-side terminal (to be described later) of the cartridge 4 come into contact with and are electrically coupled to each other by moving the cartridge 4 in an insertion direction D1, which is the −Y direction, to insert the cartridge 4 into the accommodation chamber 61 of the cartridge mounting portion 6 via the insertion/removal opening portion 674 of the first apparatus wall 67. As illustrated in FIGS. 3 and 4, the supply portion coupling process is a process in which the liquid introduction portion (to be described later) of the cartridge mounting portion 6 and the liquid supply portion (to be described later) of the cartridge 4 are coupled to each other in a state in which the electrical coupling between the apparatus-side terminal and the cartridge-side terminal is maintained. Specifically, in the supply portion coupling process, the liquid introduction portion and the liquid supply portion are coupled to each other by rotatably moving a rear wall 47 side of the cartridge 4 in a coupling direction D2 indicated by an arrow around a rotation fulcrum 698 of the cartridge mounting portion 6. In the mounted state illustrated in FIG. 4, the cartridge 4 is engaged by an engagement forming body 677 that is provided on the first apparatus wall 67 side of the cartridge mounting portion 6 to hold the mounted state.

As illustrated in FIG. 4, when the cartridge 4 is removed from the cartridge mounting portion 6, the user lifts the rear wall 47 side of the cartridge 4 to rotatably move the rear wall 47 side in a coupling release direction D3, which is a direction opposite to the coupling direction D2, around the rotation fulcrum 698. When the rotatably moving the rear wall 47 side, the engagement by the engagement forming body 677 is released. After the cartridge 4 is rotatably moved in the coupling release direction D3 and becomes the state illustrated in FIG. 3, the cartridge 4 is moved in the +Y direction which is a removal direction, and thus removed from the cartridge mounting portion 6.

A-3. Detailed Description of Mounted State of Cartridge

Figure 5:
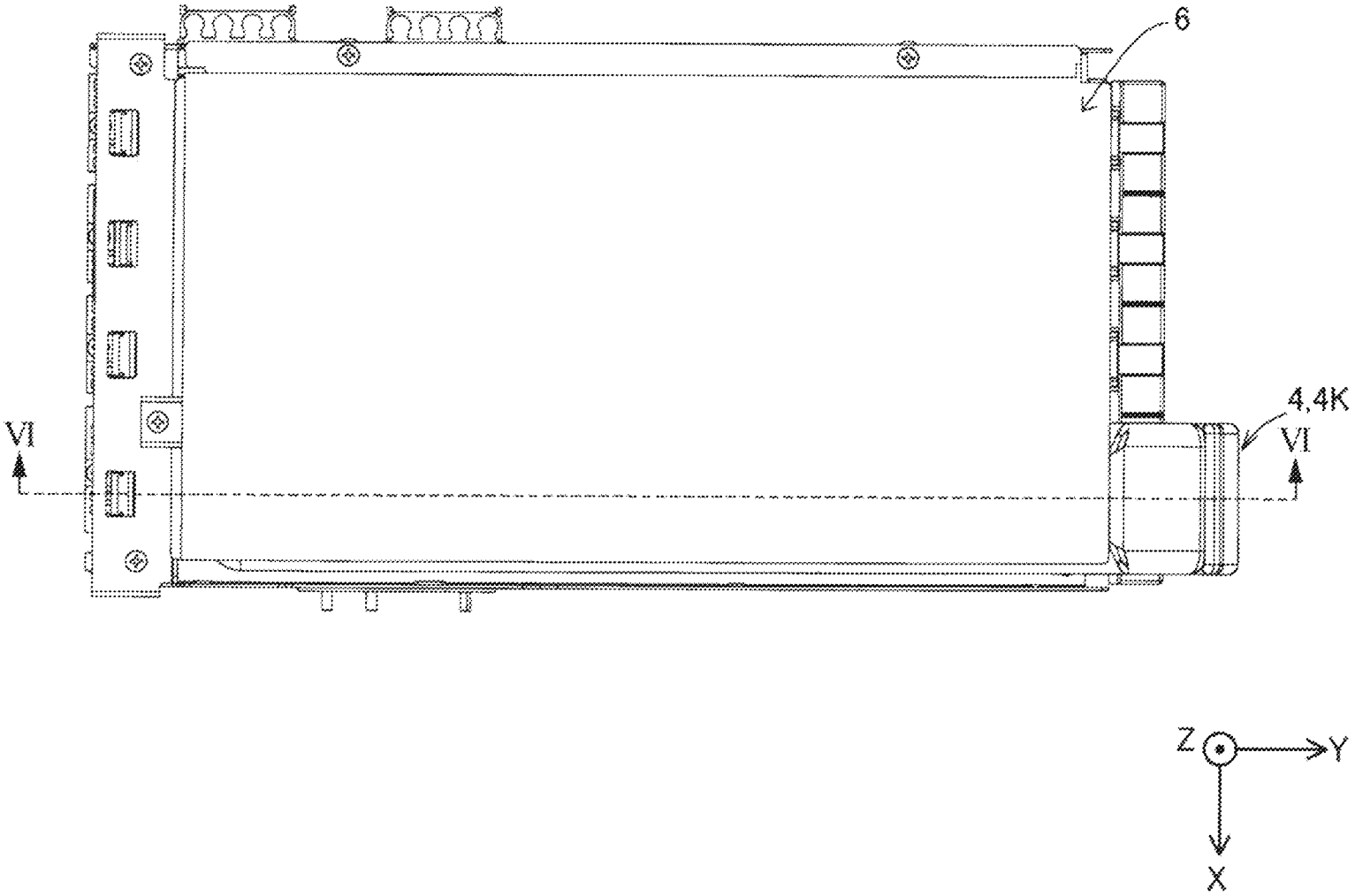
FIG. 5 is a view illustrating a cartridge mounting portion when viewed from a +Z direction.
Figure 6:
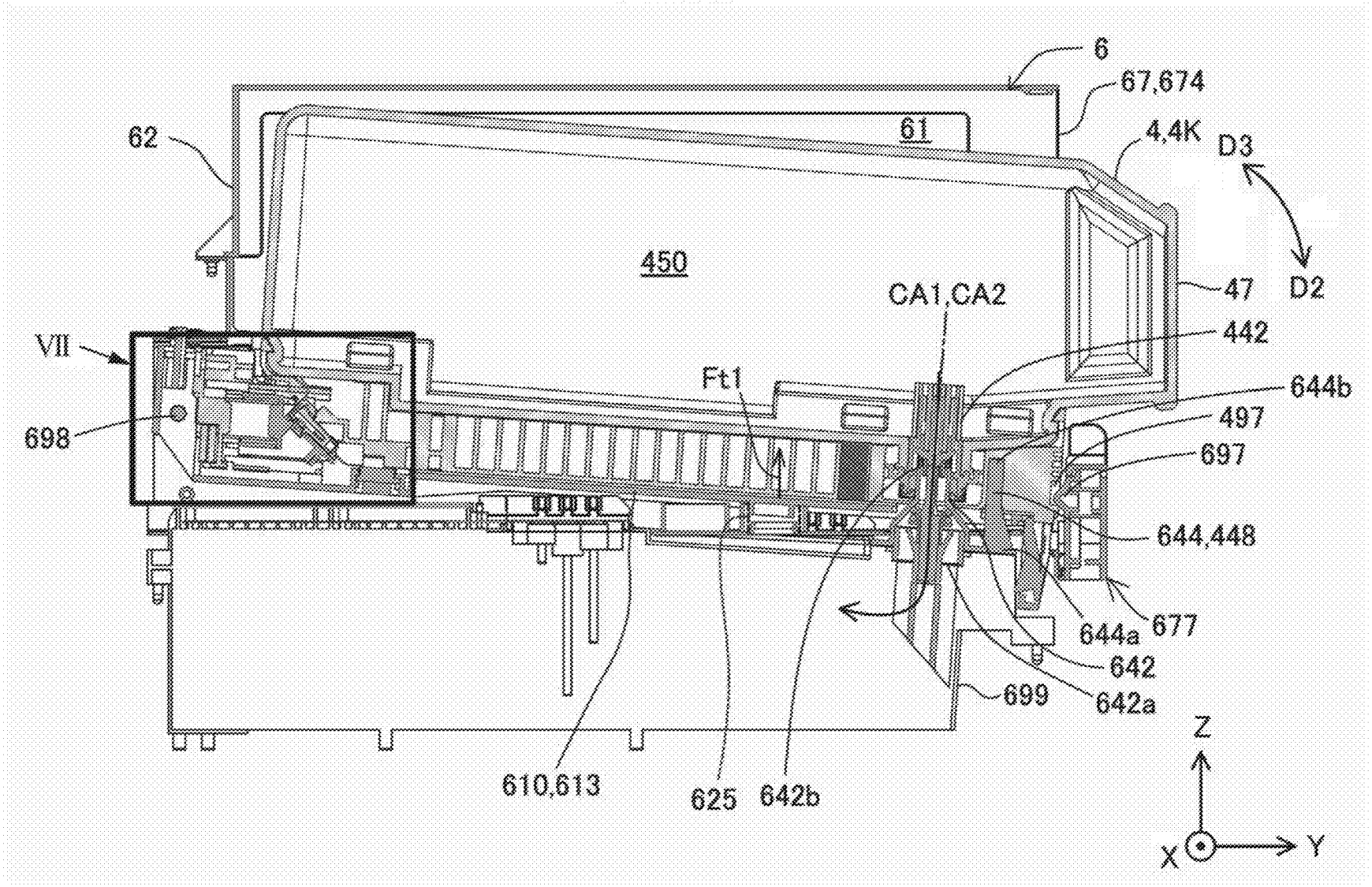
FIG. 6 is a cross-sectional view taken along line VI-VI in FIG. 5.
Figure 7:
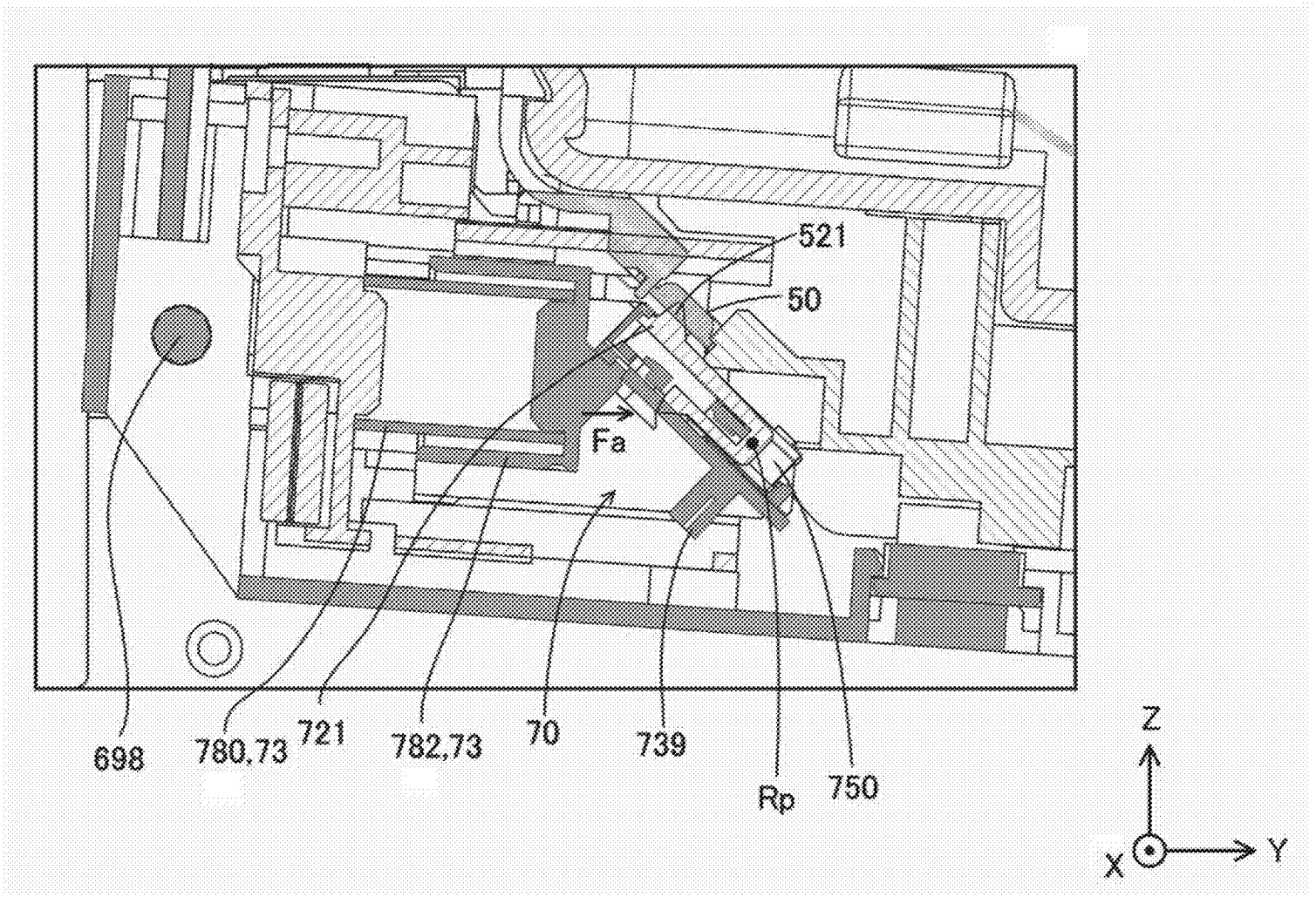
FIG. 7 is an enlarged view of a region in FIG. 6.

FIG. 5 is a view illustrating the cartridge mounting portion 6 when viewed from the +Z direction. FIG. 6 is a cross-sectional view taken along line VI-VI in FIG. 5. FIG. 7 is an enlarged view of region VII in FIG. 6. In FIG. 5, the cartridge 4K is mounted in the cartridge mounting portion 6. The mounted state of the cartridge 4 will be described with reference to FIGS. 5 to 7. The mounted state is the same for the cartridges 4C, 4M, 4Y, and 4K.

As illustrated in FIG. 6, the cartridge mounting portion 6 includes a support member 610 forming an accommodation chamber bottom wall of the accommodation chamber 61. The support member 610 supports the cartridge 4 from below. The cartridge 4 is supported by the support member 610 from the −Z direction side in a state in which the cartridge 4 is inserted into the accommodation chamber 61 of the cartridge mounting portion 6. Furthermore, the liquid supply portion 442 of the cartridge 4 is coupled to the liquid introduction portion 642 of the cartridge mounting portion 6 in the mounted state in which the cartridge 4 is mounted in the accommodation chamber 61 of the cartridge mounting portion 6. As a result, the liquid contained in a liquid containing portion 450 of the cartridge 4 is supplied to the liquid introduction portion 642 via the liquid supply portion 442. In the present embodiment, while the liquid is supplied from the liquid supply portion 442 to the liquid introduction portion 642, air contained in a liquid storage portion 699 of the cartridge mounting portion 6 becomes bubbles, and the bubbles circulate in the liquid introduction portion 642, the liquid supply portion 442, and the liquid containing portion 450. As a result, liquid-gas exchange in the liquid containing portion 450 is performed. In another embodiment, the cartridge 4 has an atmosphere communication path for allowing the liquid containing portion 450 to communicate with the outside, and the liquid-gas exchange may be performed via the atmosphere communication path. The atmosphere communication path is disposed at a different position from the liquid supply portion 442, and for example, is formed on a wall forming the liquid containing portion 450.

The liquid introduction portion 642 receives the liquid supplied from the cartridge 4. The liquid introduction portion 642 is a cylindrical member, and has an internal flow path for allowing the liquid to circulate therein. The liquid introduction portion 642 has a proximal end 642*a* and a distal end 642*b*. An opening communicating with an introduction portion flow path, which is the internal flow path, is formed in the distal end 642*b*, and the ink in the liquid supply portion 442 circulates through the introduction portion flow path via the opening. The proximal end 642*a* is coupled to the liquid storage portion 699, and the ink circulated through the introduction portion flow path circulates in the liquid storage portion 699. The liquid storage portion 699 is located on the −Z direction side of the accommodation chamber 61. The liquid storage portion 699 communicates with the discharge head 22 via the tube 24 illustrated in FIG. 1. As described above, the liquid introduction portion 642 communicates with the discharge head 22 via the liquid storage portion 699 and the tube 24. A central axis CA1 of the liquid introduction portion 642 is in parallel with a central axis CA2 of the liquid supply portion 442 in the mounted state, and tilted to the Z direction. That is, a direction along the central axis CA1, which is a direction in which the liquid introduction portion 642 extends, intersects with the insertion direction of the cartridge 4. A direction along the central axis CA2 of the liquid supply portion 442 is a direction along a direction in which the liquid supply portion 442 extends.

As illustrated in FIG. 7, in the mounted state of the cartridge 4, a circuit board 50 of the cartridge 4 and an apparatus-side terminal portion 70 of the cartridge mounting portion 6 are electrically coupled to each other by coming into contact with each other. The apparatus-side terminal portion 70 is held by a holding mechanism 73. The apparatus-side terminal portion 70 includes a plurality of apparatus-side terminals 721, a terminal holding portion 750, and a connector 739.

In the present embodiment, the plurality of (nine) apparatus-side terminals 721 are provided. Each of the plurality of apparatus-side terminals 721 is a metal plate member having conductivity. The apparatus-side terminal 721 has a terminal rotation fulcrum Rp, in which a portion where the terminal rotation fulcrum Rp is in contact with the cartridge-side terminal 521 of the circuit board 50, which is an end of the fulcrum, can be elastically deformed. A direction in which the portion where the terminal rotation fulcrum Rp is in contact with the cartridge-side terminal 521 of the circuit board 50 is elastically deformed is a direction along the X direction and the Z direction. The terminal holding portion 750 holds the plurality of apparatus-side terminals 721. The connector 739 is electrically coupled to the plurality of apparatus-side terminals 721. In addition, the connector 739 is electrically coupled to the control portion 31 of the printing apparatus 10 by wiring (not illustrated). As a result, data communication between the circuit board 50 and the control portion 31 is available.

The holding mechanism 73 includes a biasing member 780 and an attachment member 782. The biasing member 780 is composed of a coil spring. The biasing member 780 is disposed inside the attachment member 782. In addition, the apparatus-side terminal portion 70 is attached to the attachment member 782. The biasing member 780 is compressed in a state in which the insertion of the cartridge 4 into the cartridge mounting portion 6 is completed. As a result, the biasing member 780 applies an external force Fa via the attachment member 782 in a direction in which the apparatus-side terminal portion 70 is directed to a removal direction side of the cartridge 4, which is the first apparatus wall 67 side. Since the apparatus-side terminal portion 70 is pushed against the circuit board 50 by the external force Fa, the contact between the apparatus-side terminal 721 and the cartridge-side terminal 521 is maintained well.

As described above, the holding mechanism 73 holds the apparatus-side terminal portion 70 to be displaceable in a direction along the insertion direction of the cartridge 4. In addition, one end of the biasing member 780 on the apparatus-side terminal portion 70 side is configured to be slightly movable in the X direction and the Z direction intersecting with the insertion direction. As a result, the apparatus-side terminal portion 70 is held by a holding mechanism 73 to be slightly movable in the X direction and the Z direction intersecting with the insertion direction.

As illustrated in FIG. 6, in the supply port coupling process, the movement of the liquid supply portion 442 intersecting with the central axis CA2 of the liquid supply portion 442 is restricted by entering an apparatus-side supply portion positioning portion 644, which is a protrusion included in the cartridge mounting portion 6, into a supply portion positioning portion 448 having a recess shape and included in the cartridge 4. As a result, positioning of the liquid supply portion 442 to the liquid introduction portion 642 is performed. The apparatus-side supply portion positioning portion 644 has a substantially rectangular parallelepiped shape. The apparatus-side supply portion positioning portion 644 has one end 644*a* and the other end 644*b*. One end 644*a* is located on the liquid storage portion 699 side. One end 644*a* is located closer to the accommodation chamber 61 than the other end 644*b*.

In the mounted state of the cartridge 4, a main wall 613 forming a bottom portion of the support member 610 is tilted to the Y direction. Specifically, the main wall 613 of the support member 610 is tilted so as to be located on the −Z direction side, which is a lower side, toward the +Y direction side. The main wall 613 is in parallel to the Y direction in the initial arrangement state of the cartridge mounting portion 6 in which the cartridge 4 is not mounted.

In the mounted state of the cartridge 4, the cartridge mounting portion 6 includes the biasing member 625 that applies an external force Ft1 to the support member 610 in order to return the support member 610 to a position where the support member 610 is in the initial arrangement state. The biasing member 625 is a coil spring provided between the support member 610 and the liquid storage portion 699, and becomes a compressed state in the mounted state. The external force Ft1 having a +Z direction component is applied to the support member 610 depending on the compressed state. Meanwhile, in the mounted state of the cartridge 4, a cartridge engagement portion 497 of the cartridge 4 is engaged with a mounting engagement portion 697 of the cartridge mounting portion 6, and the mounted state is thus maintained. The mounting engagement portion 697 is formed on the engagement forming body 677 located on the first apparatus wall 67 side of the cartridge mounting portion 6.

As described above, as illustrated in FIG. 6, the support member 610 is pushed down in the coupling direction D2 around the rotation fulcrum 698, and the liquid supply portion 442 is thus pushed down and coupled to the liquid introduction portion 642. Further, the support member 610 is pushed up in the coupling release direction D3 around the rotation fulcrum 698, and the liquid supply portion 442 is thus pushed up and separated from the liquid introduction portion 642, and therefore, the coupling between the liquid supply portion 442 and the liquid introduction portion 642 is released.

A-4. Detailed Configuration of Cartridge 4

Figure 8:
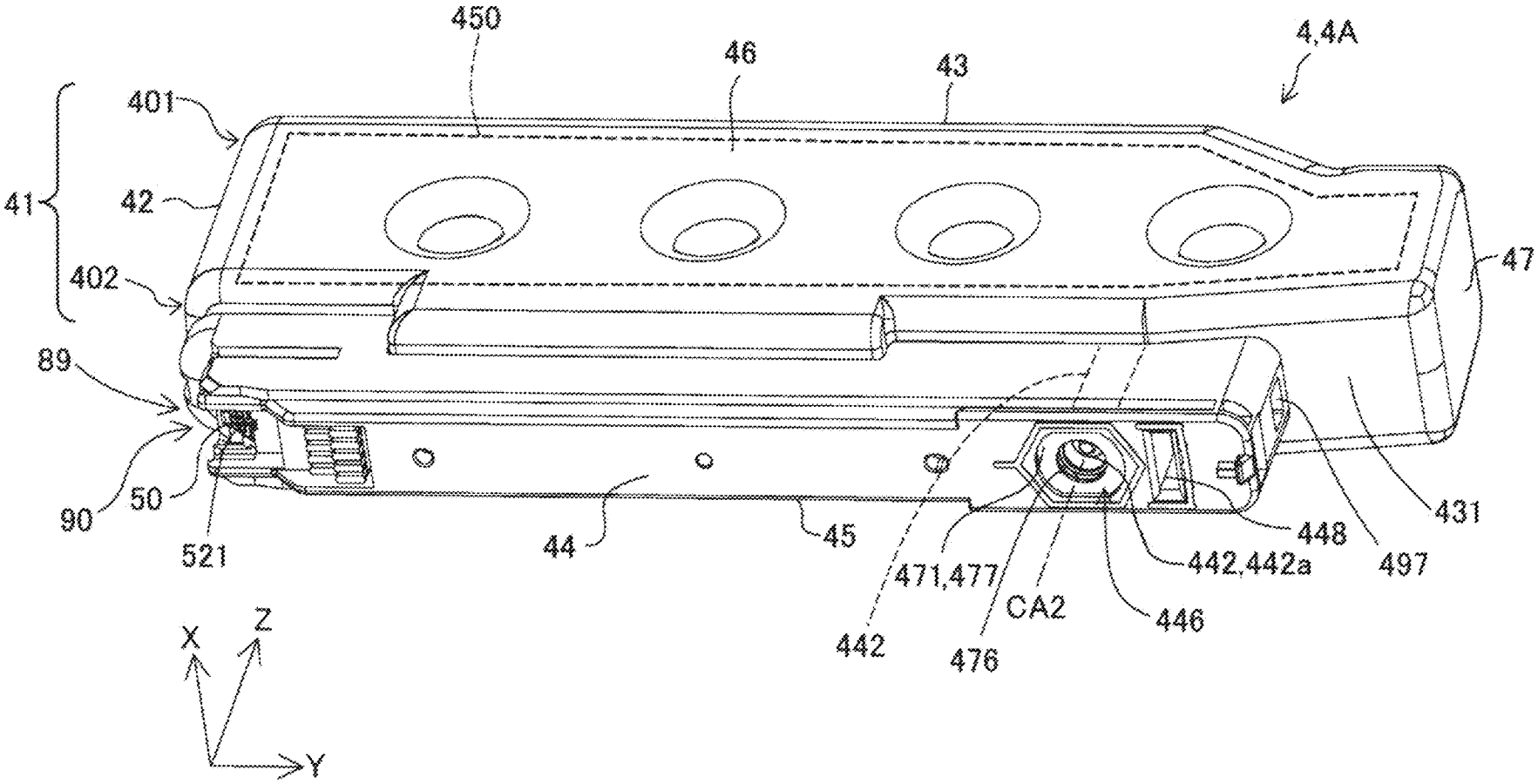
FIG. 8 is a perspective view of a first-type cartridge.
Figure 9:
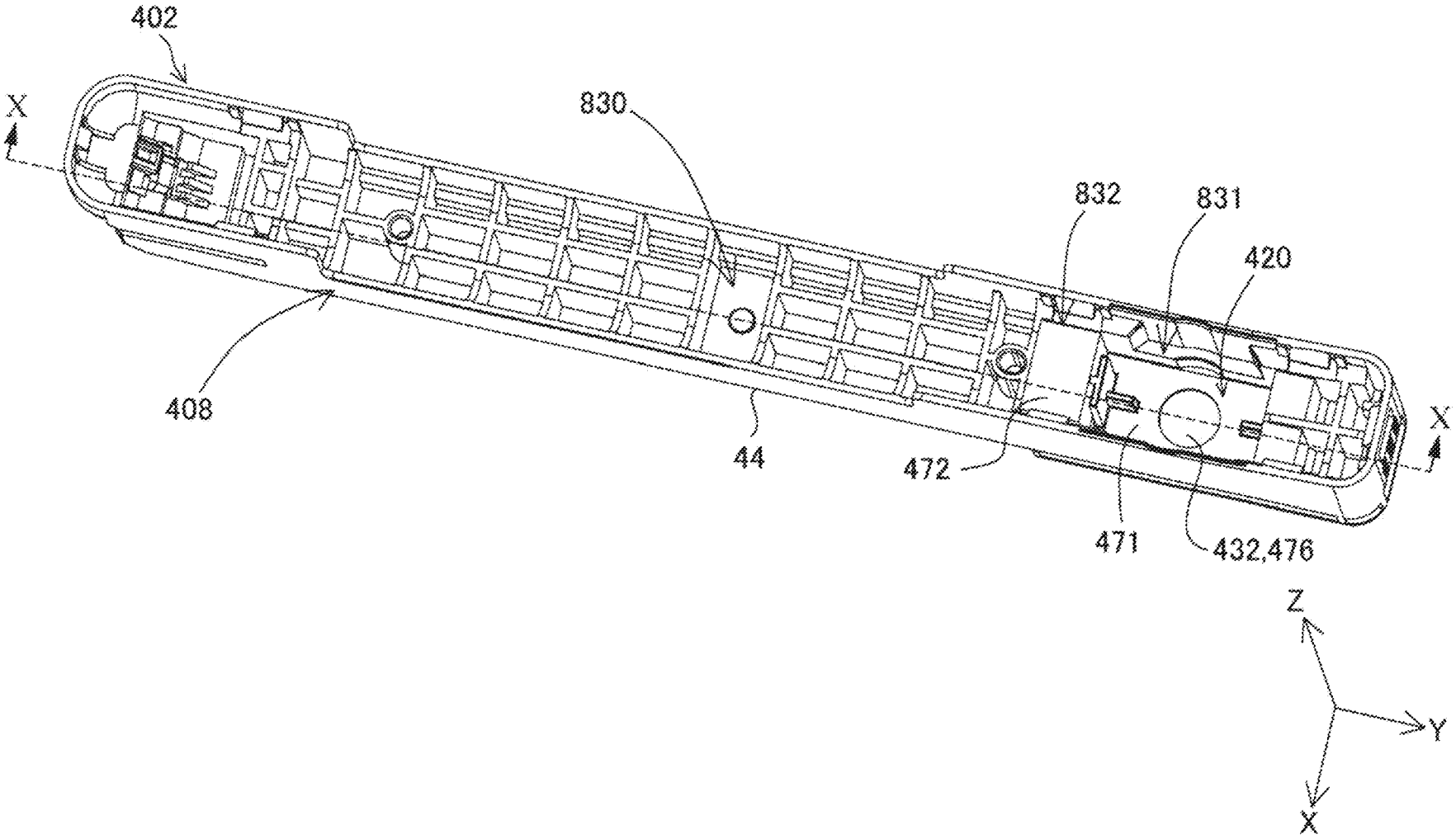
FIG. 9 is a perspective view of an adapter as an arrangement portion.
Figure 10:
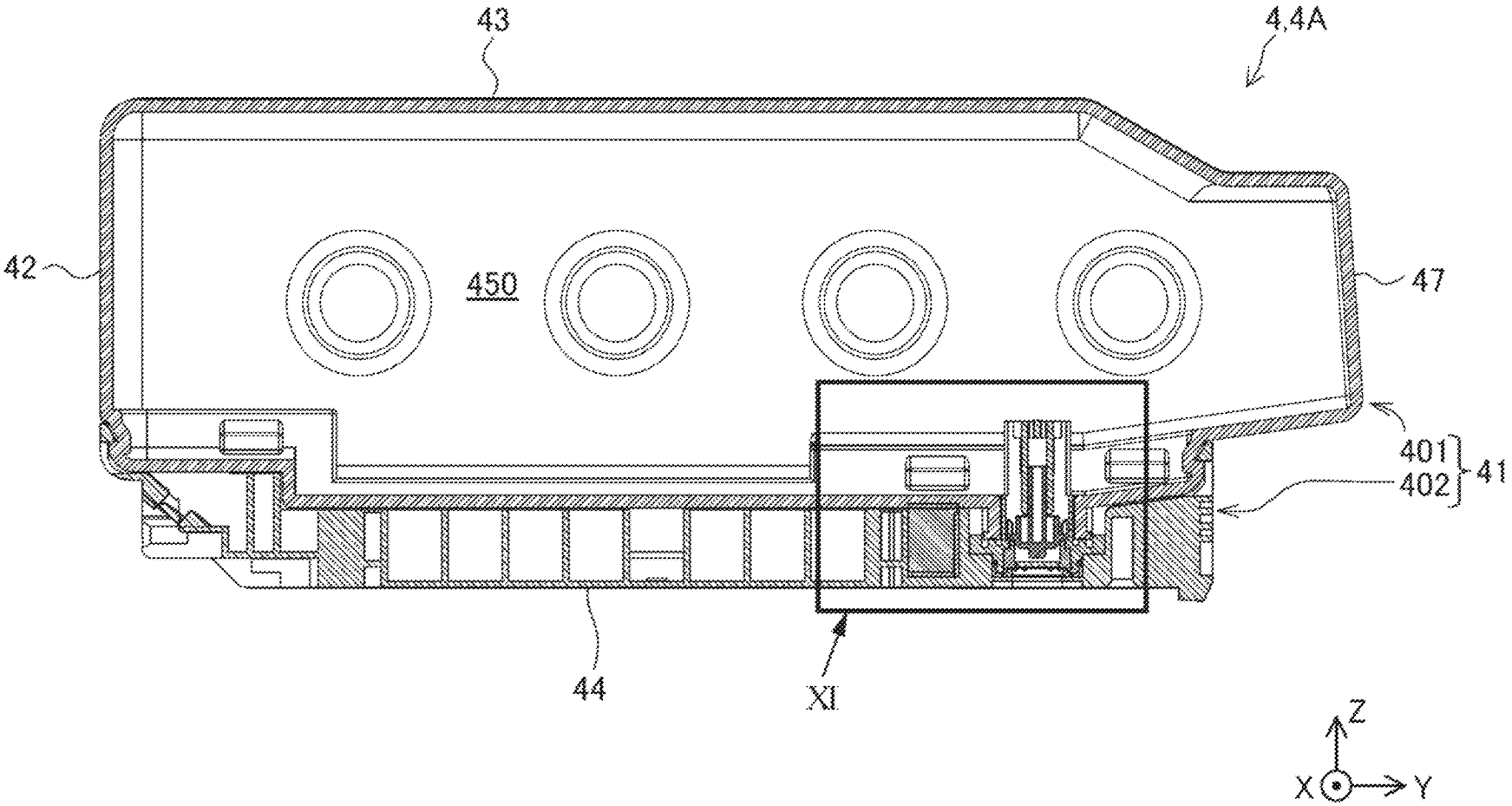
FIG. 10 is a cross-sectional view taken along line X-X in FIG. 9.
Figure 11:
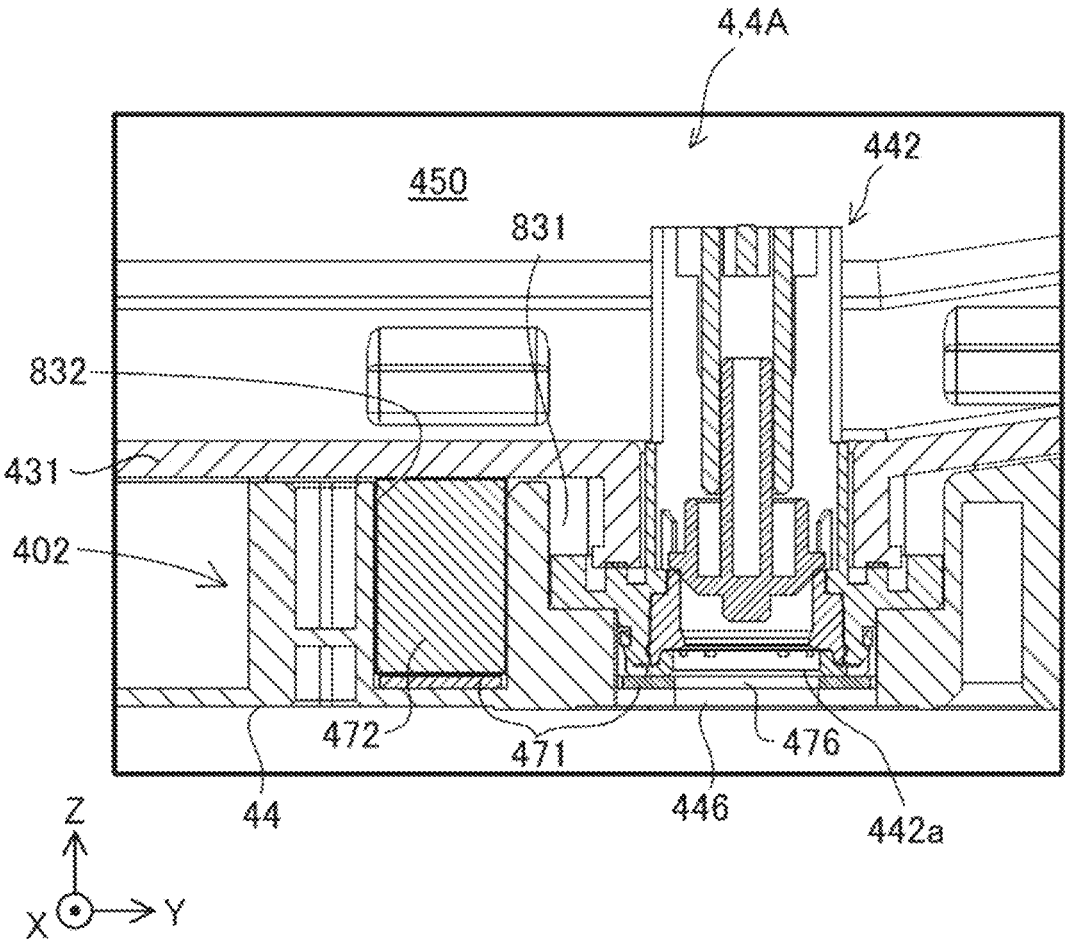
FIG. 11 is an enlarged view of a region in FIG. 10.

FIG. 8 is a perspective view of the first-type cartridge 4A. FIG. 9 is a perspective view of an adapter as an arrangement portion. FIG. 10, which is a cross-sectional view taken along line X-X in FIG. 9, illustrates a cross section of the first-type cartridge 4A including an adapter 402. FIG. 11 is an enlarged view of region XI in FIG. 10. The first-type cartridge 4A and the second-type cartridge 4B illustrated in FIG. 1 have a difference in volume of the liquid containing portion 450. Specifically, a width of a liquid containing body 401 (to be described later) of the first-type cartridge 4A is larger than a width of the liquid containing body 401 of the second-type cartridge 4B. Therefore, the volumes of the liquid containing portions 450 in the first-type cartridge 4A and the second-type cartridge 4B are different. For another configuration such as the adapter 402, since the first-type cartridge 4A has the same configuration as the second-type cartridge 4B, in the following, detailed descriptions of the cartridge 4 will be described with reference to the first-type cartridge 4A. In the following, the first-type cartridge 4A is simply referred to as the cartridge 4. In the drawings illustrating the cartridge 4, the X, Y, and Z directions are based on a completed state of the terminal coupling process in FIG. 3, which is a state in which the insertion of the cartridge 4 into the cartridge mounting portion 6 is completed. That is, in the drawings illustrating the cartridge 4, the X, Y, and Z directions are based on a state before the supply portion coupling process in which the support member 610 is rotatably moved.

As illustrated in FIG. 8, an appearance of the cartridge 4 has a substantially rectangular parallelepiped shape. In the cartridge 4, a direction along the −Y direction, which is the insertion direction of the cartridge mounting portion 6, is defined as a longitudinal direction, the X direction is defined as a lateral direction as a width direction, and the Z direction is defined as a height direction. A dimension of the cartridge 4 in the longitudinal direction is the largest, and a dimension of the cartridge 4 in the lateral direction is the smallest.

The cartridge 4 includes a cartridge main body 41, and the circuit board 50 attached to the cartridge main body 41. In the present embodiment, the cartridge main body 41 is composed of two members. Specifically, the cartridge main body 41 includes the liquid containing body 401, and the adapter 402, as an arrangement portion, attached to the liquid containing body 401 by engagement. In other embodiments, the cartridge main body 41 may be integrally formed.

The liquid containing body 401 and the adapter 402 are each molded by, for example, injection molding a synthetic resin such as polypropylene. The liquid containing body 401 and the adapter 402 may be formed of the same material or different materials.

The cartridge main body 41 has a front wall 42, a rear wall 47, an upper wall 43, a bottom wall 44, a first side wall 45, a second side wall 46, and a corner portion 89. The walls 42, 43, 44, 45, 46, and 47 are referred to as surfaces 42, 43, 44, 45, 46, and 47, respectively. The front wall 42 and the rear wall 47 face each other in the Y direction along the insertion direction. The upper wall 43 and the bottom wall 44 face each other in the Z direction. The Z direction is parallel with the central axis CA2 along the direction in which the liquid supply portion 442 extends. The first side wall 45 and the second side wall 46 face each other in the X direction.

The front wall 42 is located on the insertion direction side in which the cartridge 4 is inserted into the cartridge mounting portion 6. That is, the front wall 42 forms an insertion distal end surface on the −Y direction side, which is the insertion direction side. The rear wall 47 forms a surface on the +Y direction side, which is the removal direction. The upper wall 43 is located on the +Z direction side, and intersects with the front wall 42 and the rear wall 47. The bottom wall 44 is located on the −Z direction side, which is the gravity direction side in the mounted state, and forms a coupling distal end surface in the coupling direction D2 illustrated in FIG. 3. That is, the bottom wall 44 is located on the coupling direction D2 side. The bottom wall 44 intersects with the front wall 42 and the rear wall 47. An opening portion 446 through which the liquid introduction portion 642 is inserted is formed in the bottom wall 44. A positional relationship in which the opening portion 446 and the liquid supply portion 442 overlap is made, when the cartridge 4 is viewed from the bottom wall 44. In the present embodiment, the liquid supply portion 442 is arranged so that the central axis CA2 of the liquid supply portion 442 passes through the opening portion 446.

The first side wall 45 is located on the −X direction side, and the second side wall 46 is located on the +X direction side. The first side wall 45 intersects with the front wall 42 and the rear wall 47, and the second side wall 46 intersects with the upper wall 43 and the bottom wall 44. The corner portion 89 is provided at a corner part where the front wall 42 intersects with the bottom wall 44. The corner portion 89 has a terminal arrangement portion 90 having a recess shape recessed inwardly. The circuit board 50 is attached to the terminal arrangement portion 90.

The liquid containing body 401 has the liquid containing portion 450 containing the liquid, and the liquid supply portion 442. The liquid supply portion 442 is a cylindrical member protruding from a containing body bottom wall 431 of the liquid containing body 401 that faces the upper wall 43. The liquid supply portion 442 is coupled to the liquid introduction portion 642 in the mounted state, and supplies the liquid in the liquid containing portion 450 to the discharge head 22 of the printing apparatus 10 via the liquid introduction portion 642. As illustrated in FIG. 11, the liquid supply portion 442 has the supply portion distal end 442*a* as a distal end that forms an opening that allows the liquid to lead to the outside.

As illustrated in FIG. 8, a cartridge-side element cooperating with each element of the cartridge mounting portion 6 is arranged on the adapter 402. An example of the cartridge-side element includes the circuit board 50, the supply portion positioning portion 448, the cartridge engagement portion 497, or the opening portion 446.

As illustrated in FIG. 9, the adapter 402 has the bottom wall 44 and a side wall 408 that is raised from a periphery of the bottom wall 44 toward the liquid containing body 401 side. The side wall 408 includes a wall constituting the front wall 42, a wall constituting the rear wall 47, a wall constituting the first side wall 45, and a wall constituting the second side wall 46. As described above, the adapter 402 has a recess shape having the bottom wall 44 as a bottom. A side of the adapter 402 that faces the bottom wall 44 is open, and the liquid supply portion 442 is arranged in a recess 830 of the adapter 402 via the opening. Specifically, as illustrated in FIG. 11, the adapter 402 has a part including the supply portion distal end 442*a*, which is a distal end of the liquid supply portion 442, arranged inside thereof. A part of the recess 830 of the adapter 402 in which the liquid supply portion 442 is arranged is referred to as a supply portion arrangement portion 831.

As illustrated in FIG. 11, the bottom wall 44 faces the supply portion distal end 442*a* of the liquid supply portion 442 in the Z direction. The opening portion 446 of the bottom wall 44 is formed at a position facing the supply portion distal end 442*a* in the Z direction.

As illustrated in FIG. 9, the cartridge 4 further includes a first liquid absorbing member 471, and a second liquid absorbing member 472. The first liquid absorbing member 471 and the second liquid absorbing member 472 are members for holding the liquid by a predetermined capillary force, and may be members formed of, for example, a foamable member such as urethane foam, a porous body formed of polyvinyl alcohol, and non-woven fabric. The first liquid absorbing member 471 is, for example, a sheet-shaped member. The second liquid absorbing member 472 is a block-shaped member having a larger volume than the first liquid absorbing member 471. In the present embodiment, the second liquid absorbing member 472 has a rectangular parallelepiped shape. A difference in volume is based on a state in which the first and second liquid absorbing members 471 and 472 are assembled as the cartridge 4.

The first liquid absorbing member 471 is arranged inside the adapter 402, that is, in the recess 830. Specifically, the first liquid absorbing member 471 is arranged over the supply portion arrangement portion 831 and an absorbing member arrangement portion 832, and is located between the supply portion distal end 442*a* and the bottom wall 44. The absorbing member arrangement portion 832 is a constituent element of the recess 830 adjacent to the supply portion arrangement portion 831. The first liquid absorbing member 471 is arranged on an inner surface of the bottom wall 44. The first liquid absorbing member 471 has an absorbing member opening portion 476 through which the liquid introduction portion 642 is inserted in the mounted state of the cartridge 4. That is, a positional relationship in which the absorbing member opening portion 476, the opening portion 446, and the supply portion distal end 442*a* overlap is made, when the cartridge 4 is viewed from the bottom wall 44. In addition, as illustrated in FIG. 8, a part of the first liquid absorbing member 471 is exposed from the opening portion 446. That is, a positional relationship in which the part of the first liquid absorbing member 471 overlaps the opening portion 446 is made, when the cartridge 4 is viewed from the bottom wall 44. The part of the first liquid absorbing member 471 exposed from the opening portion 446 is referred to as an exposed part 477.

As illustrated in FIG. 9, the second liquid absorbing member 472 is arranged inside the adapter 402, that is, in the absorbing member arrangement portion 832 of the recess 830. The second liquid absorbing member 472 is arranged at a position where it is not exposed from the opening portion 446. As illustrated in FIG. 11, the second liquid absorbing member 472 is arranged on the first liquid absorbing member 471 to come into contact with the first liquid absorbing member 471. The second liquid absorbing member 472 is arranged on the absorbing member arrangement portion 832 in a slightly compressed state while being interposed between the bottom wall 44 and the containing body bottom wall 431. As a result, since the contact between the first liquid absorbing member 471 and the second liquid absorbing member 472 can be maintained well, the liquid absorbed by the first liquid absorbing member 471 can be easily moved to the second liquid absorbing member 472.

The second liquid absorbing member 472 has a greater capillary force than the first liquid absorbing member 471. The capillary force, which is a force absorbing the liquid, is generated by a capillary phenomenon. A magnitude of the capillary force can be controlled by a material of the first liquid absorbing member 471 or second liquid absorbing member 472, a size of a hole, or the like. For example, by using a member having a finer mesh than the first liquid absorbing member 471 for the second liquid absorbing member 472, the capillary force of the second liquid absorbing member 472 can be greater than that of the first liquid absorbing member 471. As the capillary force of the second liquid absorbing member 472 is greater than that of the first liquid absorbing member 471, the liquid captured by the first liquid absorbing member 471 can be smoothly moved to the second liquid absorbing member 472 with a difference of the capillary force as a driving force. As a result, an amount of liquid that can be held by the first liquid absorbing member 471 can be prevented from reaching an upper limit thereof, thereby preventing the liquid from being leaked from the first liquid absorbing member 471.

According to the embodiment, as illustrated in FIG. 8, since the exposed part 477 of the first liquid absorbing member 471 is exposed from the opening portion 446, the liquid can be captured by the exposed part 477 of the first liquid absorbing member 471 even if the liquid is scattered from the liquid introduction portion 642 in a process of removing the cartridge 4 from the printing apparatus 10. In the printing system 1 of the present embodiment, as illustrated in FIG. 6, the liquid supply portion 442 is pushed up in the coupling release direction D3 having the +Z direction component, which is an upward direction, and the coupling between the liquid introduction portion 642 and the liquid supply portion 442 is thus released. In the process in which the liquid supply portion 442 is pushed up and the coupling with the liquid introduction portion 642 is released, the liquid in the liquid introduction portion 642 may be drawn up according to the pushing-up operation of the liquid supply portion 442, and scattered from the liquid introduction portion 642 in the upward direction. However, according to the embodiment, the exposed part 477 can capture the liquid scattered from the liquid introduction portion 642 in the upward direction other than the gravity direction, for example. Further, according to the embodiment, as illustrated in FIG. 11, since the second liquid absorbing member 472 is in contact with the first liquid absorbing member 471, the liquid captured by the first liquid absorbing member 471 can be moved to the second liquid absorbing member 472 side and held by the second liquid absorbing member 472. That is, according to the embodiment, the second liquid absorbing member 472 can hold an amount of liquid that cannot be held by the first liquid absorbing member 471 alone.

According to the present embodiment, as illustrated in FIG. 11, the second liquid absorbing member 472 is a block-shaped member, and has a larger volume than the first liquid absorbing member 471. As a result, the second liquid absorbing member 472 can hold a larger amount of liquid.

B. Other Embodiments

B-1. Other Embodiment 1

According to the embodiment, as illustrated in FIGS. 9 and 11, the first liquid absorbing member 471 is a sheet-shaped member, and the second liquid absorbing member 472 is a block-shaped member. However, the shapes of the first liquid absorbing member 471 and the second liquid absorbing member 472 are not limited thereto. For example, the first liquid absorbing member 471 may be a block-shaped member, and the second liquid absorbing member 472 may be a sheet-shaped member. In the embodiment, the volume of the second liquid absorbing member 472 is larger than that of the first liquid absorbing member 471, but is not limited thereto. For example, the second liquid absorbing member 472 has a smaller volume than the first liquid absorbing member 471. In the embodiment, the capillary force of the second liquid absorbing member 472 is greater than that of the first liquid absorbing member 471, but is not limited thereto. For example, the capillary force of the second liquid absorbing member 472 may be same as or less than the capillary force of the first liquid absorbing member 471. As described above, the same effect is obtained in that the embodiment has the same configuration as the first embodiment.

B-2. Other Embodiment 2

In the embodiment, as illustrated in FIGS. 2 to 6, the coupling or release of the coupling between the liquid supply portion 442 and the liquid introduction portion 642 is performed by rotatably moving the cartridge 4 around the rotation fulcrum 698, but is not limited thereto. For example, the coupling or release of the coupling between the liquid supply portion 442 and the liquid introduction portion 642 may be performed by moving the cartridge 4 along a straight line such as the Z direction.

B-3. Other Embodiment 3

The present disclosure is not limited to an ink jet printer and an ink cartridge thereof, but can be applied to a cartridge mounted in any printing apparatus that ejects other liquids except for ink. For example, various printing apparatuses and cartridges thereof can be applied as follows.

(1) Image recording apparatus such as a fax machine
(2) Printing apparatus that ejects color materials used in manufacturing a color filter for an image display apparatus such as a liquid crystal display
(3) Printing apparatus that ejects electrode materials used in forming electrodes such as an organic electroluminescence (EL) display or field emission display (FED)
(4) Printing apparatus that ejects a liquid including bio-organic matters used in manufacture of a biochip
(5) Sample printing apparatus as precision pipette
(6) Printing apparatus of lubricating oil
(7) Printing apparatus of resin liquid
(8) Printing apparatus that ejects lubricating oil to a precision machine, such as a watch and a camera, with a pinpoint
(9) Printing apparatus that ejects a transparent resin liquid, such as an ultraviolet curable resin liquid, to a substrate to form a micro-hemispherical lens (optical lens) used for an optical communication element or the like
(10) Printing apparatus that ejects an acidic or alkaline etching solution to etch a substrate or the like
(11) Printing apparatus including a liquid ejecting head that discharges any other minute amount of liquid droplets The "liquid droplets" refers to a state of the liquid discharged from the printing apparatus, and includes those having trails with particles, tears, or threads. In addition, the "liquid" here may be any material that can be ejected by the liquid ejecting apparatus. For example, the "liquid" may be a material in a state where the substance is in a liquid phase, and liquid materials with high or low viscosity and liquid materials such as sol, gel water, other inorganic solvents, organic solvents, solutions, liquid resins, and liquid metal are also included in the "liquid". In addition, the "liquid" includes not only a liquid as one state of a substance but also a "liquid" obtained by dissolving, dispersing or mixing particles of a functional material made of a solid such as a pigment or metal particles in a solvent. In addition, representative examples of the liquid include ink and liquid crystal as described in the above embodiment. Here, the ink includes various liquid compositions such as normal water-based ink and oil-based ink, gel ink, and hot-melt ink.

C. Other Aspects

The present disclosure is not limited to the above-described embodiment, and can be realized with various configurations without departing from the spirit of the present disclosure. For example, the technical features of the embodiments corresponding to the technical features in each embodiment described below can be appropriately replaced or combined to solve some or all of the above-described problems, or to achieve some or all of the above effects. In addition, when the technical feature is not described as essential in the present specification, it can be deleted as appropriate. In addition, when the technical feature is not described as essential in the present specification, it can be appropriately deleted.

(1) According to a first aspect of the present disclosure, there is provided a cartridge that is detachably mounted in a printing apparatus including a liquid introduction portion. The cartridge includes: a liquid containing portion containing a liquid; a liquid supply portion coupled to the liquid introduction portion and supplying the liquid to the printing apparatus; an arrangement portion having the liquid supply portion arranged inside thereof and having a bottom wall facing a distal end of the liquid supply portion, in which the bottom wall has an opening portion through which the liquid introduction portion is inserted at a position facing the distal end; a first liquid absorbing member arranged inside the arrangement portion, of which a part of the first liquid absorbing member is exposed from the opening portion; and a second liquid absorbing member arranged inside the arrangement portion and coming into contact with the first liquid absorbing member. According to the aspect, since the first liquid absorbing member is exposed from the opening portion, the liquid can be captured by the first liquid absorbing member even if the liquid is scattered from the liquid introduction portion in a process of removing the cartridge from the printing apparatus. Further, according to the aspect, since the second liquid absorbing member is in contact with the first liquid absorbing member, the liquid captured by the first liquid absorbing member can be moved to the second liquid absorbing member side and held by the second liquid absorbing member. That is, according to the aspect, the second liquid absorbing member can hold an amount of liquid that cannot be held by the first liquid absorbing member alone.

(2) In the aspect, the second liquid absorbing member may have a greater capillary force than the first liquid absorbing member. According to the aspect, the liquid captured by the first liquid absorbing member can be smoothly moved to the second liquid absorbing member. As a result, an amount of liquid that can be held by the first liquid absorbing member can be prevented from reaching an upper limit thereof, thereby preventing the liquid from being leaked from the first liquid absorbing member.

(3) In the aspect, the first liquid absorbing member may be a sheet-shaped member, and the second liquid absorbing member may be a block-shaped member having a larger volume than the first liquid absorbing member. According to the aspect, the second liquid absorbing member can hold a larger amount of liquid.

(4) According to a second aspect of the present disclosure, there is provided a printing system. The printing system includes the cartridge according to the aspect, and the printing apparatus having the liquid introduction portion coupled to the liquid supply portion. According to the aspect, since the first liquid absorbing member is exposed from the opening portion, the liquid can be captured by the first liquid absorbing member even if the liquid is scattered from the liquid introduction portion upon removing the cartridge from the printing apparatus. Further, according to the aspect, since the second liquid absorbing member is in contact with the first liquid absorbing member, the liquid captured by the first liquid absorbing member can be moved to the second liquid absorbing member side and held by the second liquid absorbing member. That is, according to the aspect, the second liquid absorbing member can hold the liquid that cannot be held by the first liquid absorbing member alone.

(5) In the aspect, the printing apparatus further may have a support member supporting the cartridge, and a rotation fulcrum for rotatably moving the support member, in which as the support member is pushed down around the rotation fulcrum, the liquid supply portion may be pushed down and coupled to the liquid introduction portion, and as the support member is pushed up around the rotation fulcrum, the liquid supply portion may be pushed up and the coupling with the liquid introduction portion may be released. Here, in a process in which the liquid supply portion is pushed up and the coupling with the liquid introduction portion is released, the liquid in the liquid introduction portion may be leaked from the liquid introduction portion in an upward direction according to the pushing-up operation of the liquid supply portion. According to the aspect, even if the liquid is leaked from the liquid introduction portion in the upward direction, the liquid can be captured by an exposed part of the first liquid absorbing member because the first liquid absorbing member is exposed from the opening portion.

In addition to the aspect described above, the present disclosure can be realized as an aspect such as a method of manufacturing a cartridge.

What is claimed is:

1. A printing system comprising:

a printing apparatus; and a cartridge that is detachably mounted in the printing apparatus, wherein the cartridge includes:

a liquid containing portion containing a liquid;

a liquid supply portion coupled to the liquid introduction portion and supplying the liquid to the printing apparatus;

an arrangement portion having the liquid supply portion arranged inside thereof and having a bottom wall facing a distal end of the liquid supply portion, in which the bottom wall has an opening portion through which the liquid introduction portion is inserted at a position facing the distal end;

a first liquid absorbing member arranged inside the arrangement portion, of which a part of the first liquid absorbing member is exposed from the opening portion; and a second liquid absorbing member arranged inside the arrangement portion and coming into contact with the first liquid absorbing member, the printing apparatus includes:

a liquid introduction portion configured to be coupled to the liquid supply portion of the cartridge;

a support member supporting the cartridge; and a rotation fulcrum for rotatably moving the support member, as the support member is pushed down around the rotation fulcrum, the liquid supply portion is pushed down and coupled to the liquid introduction portion, and as the support member is pushed up around the rotation fulcrum, the liquid supply portion is pushed up and the coupling with the liquid introduction portion is released.

2. The printing system according to claim 1, wherein the second liquid absorbing member has a greater capillary force than the first liquid absorbing member.

3. The printing system according to claim 1, wherein the first liquid absorbing member is a sheet-shaped member, and the second liquid absorbing member is a block-shaped member having a larger volume than the first liquid absorbing member.

* * * * *